United States Patent [19]

Newhouse et al.

[11] Patent Number: 4,861,122

[45] Date of Patent: Aug. 29, 1989

[54] STORAGE CABINET

[75] Inventors: Thomas J. Newhouse, Grand Rapids; Lynne M. Allen, Holland; Donald D. Goeman, Holland, all of Mich.

[73] Assignee: Herman Miller, Inc., Zeeland, Mich.

[21] Appl. No.: 200,950

[22] Filed: Jun. 1, 1988

Related U.S. Application Data

[63] Continuation-in-part of Ser. No. 59,543, Jun. 8, 1987.

[51] Int. Cl.[4] ..... A47B 91/00

[52] U.S. Cl. ..... 312/317.1; 312/250

[58] Field of Search ..... 312/317, 250, 333, 341 R, 312/321, 286, 246, 317 A, 283; 211/151

[56] References Cited

U.S. PATENT DOCUMENTS

| | | | |
|---|---|---|---|
| 827,649 | 7/1906 | Murphy . | |
| 1,236,324 | 8/1917 | Leonard . | |
| 1,281,923 | 10/1918 | Fales . | |
| 1,954,384 | 4/1934 | Hurt . | |
| 1,969,749 | 8/1934 | Harsh | 312/333 |
| 2,066,608 | 1/1937 | Bushnell . | |
| 2,875,009 | 8/1954 | Glover . | |
| 3,067,882 | 4/1961 | Ribbens et al. . | |
| 3,112,912 | 12/1963 | Alvarez . | |
| 3,252,614 | 5/1966 | Evans . | |
| 3,542,446 | 11/1970 | Joyce . | |
| 3,698,565 | 10/1972 | Weber . | |
| 4,023,875 | 5/1977 | Difley et al. | 312/333 |
| 4,174,486 | 11/1979 | Winkler . | |
| 4,274,687 | 6/1981 | Bayles et al. . | |
| 4,318,575 | 3/1982 | Redlich | 312/250 |
| 4,337,988 | 7/1982 | Schenck | 312/250 |
| 4,377,241 | 3/1983 | Schreiner . | |
| 4,580,851 | 4/1986 | Nelson | 312/341 R |
| 4,618,192 | 10/1986 | Kelley . | |

FOREIGN PATENT DOCUMENTS

| | | |
|---|---|---|
| 166064 | 11/1949 | Austria . |

*Primary Examiner*—Victor N. Sakran

*Attorney, Agent, or Firm*—Varnum, Riddering, Schmidt & Howlett

[57] ABSTRACT

A cabinet (10) comprises a housing (12) and a drawer (14) slidably mounted to the housing (12). The drawer includes a shroud (52), a drawer front (56) mounted at a front portion (59) of the shroud (52) and a back panel (60) mounted at a rear portion (57) of the shroug (52). The drawer front (56) and back panel (60) extend between first and second lateral sides (49, 51) of the drawer (14). The drawer further includes a plurality of vertically spaced horizontal support rails (16) removably mounted to and between the drawer front (56) and the back panel (60) at one of the first and second sides (49, 51) of the drawer (14). The rails (16) are adapted to support work tools (18) at a plurality of vertical and horizontal positions in the drawer (14).

16 Claims, 4 Drawing Sheets

STORAGE CABINET

CROSS REFERENCE TO RELATED APPLICATION

This application is a continuation-in-part application of U.S. patent application Ser. No. 059,543 filed June 8, 1987, entitled Tool Cabinet.

FIELD OF THE INVENTION

The invention relates to cabinets for use preferably in office environments and particularly to freestanding cabinets having drawers with interiors adapted to organize and store work accessories and the like.

BACKGROUND OF THE INVENTION

In modern office environments of both the conventional type, with rows of private, fully partitioned offices having freestanding desks, credenzas and the like, as well as in modular office systems of the so-called "open plan" type, with rows of office cubicles partitioned by half-height freestanding panels, there has been a growing need for storage cabinets, cases or the like adapted to hold in a highly organized arrangement a large and varying number of work accessories. Because organization of work space in modern office environments is vital to work space efficiency and to obtaining a quality work product, a means within a cabinet which promotes such organization is very desirable.

It has also been desirable to provide a storage cabinet of this type, wherein work tools for storing the work accessories are adapted to be interchangeably positioned at various positions within the cabinet to accommodate workers of differing physical stature and to achieve a variety of organizational schemes. In addition, it has been desirable to provide the cabinet with a sliding drawer or the like, to close off from view the work accessories stored in the cabinet when not in use, wherein the mounting of the drawer to the cabinet is sufficiently strong so as to accommodate a large number of work accessories. It has been further desirable to provide a storage cabinet which is easily movable or transportable with relatively little effort to different loci in an office and between offices.

Storage cabinets and the like usable in office environments are known. Unfortunately, prior-art storage cabinets do not possess all of the above-described desirable characteristics.

For example, Kelly U.S. Pat. No. 4,618,192, issued Oct. 21, 1986, discloses a wall-mounted cabinet comprising a top wall, a bottom wall, two identical sidewalls, a back wall and a extruded member secured to the back wall and forming a plurality of vertically disposed horizontal hanger rails having indentations forming lips. Work tools, such as a pair of bookends and a variety of organizers such as trays, are removably mounted to the rails through hooks which rest on the lips and in the indentations of the rails. Although Kelly discloses a system within a cabinet to organize work tools, Kelly does not incorporate a pull-out drawer and is not freestanding and readily movable to different locations within an office or between offices.

In addition, U.S. Pat. No. 4,618,192 to Bayles et al., issued June 23, 1981, discloses a freestanding cabinet incorporating a series of horizontally stacked rails. Storage pins and trays are removably mounted to the rails by downwardly-depending lips secured to the bins and trays and which hook over the rails. Bayles et al.'s cabinet, however, does not have a drawer for hiding from view the contents of the cabinet and is not easily transportable in an office and between offices. Similarly, U.S. Pat. No. 4,174,468 to Winkler, issued Nov. 13, 1976, discloses an adjustable shelving and storage system wherein a cabinet has a plurality of rails secured to a back wall of the cabinet. However, like the cabinet of Bayles et al., Winkler's cabinet is not easily movable and does not have other of the above-described desirable characteristics.

SUMMARY OF THE INVENTION

According to the invention, a cabinet comprises a housing adapted to rest on the floor and a drawer slidably received in the housing for movement between open and closed conditions. The drawer is adapted to be supported by the floor at least in the open condition of the drawer.

The housing further comprises positioning means adapted to engage the drawer when the drawer is moved to the closed condition to dispose the drawer in a predetermined position relative to the housing regardless of the height of the housing relative to the floor and the contour of the floor.

The housing includes a base. The drawer further comprises wheel means adapted to engage the floor to support the drawer from the floor at least in the open condition. The positioning means comprises ramp means mounted on the base. The wheel means is adapted to engage the ramp means when the drawer is moved to the closed condition to dispose the drawer in a predetermined position relative to the housing.

The ramp means comprises a means for resisting movement of the wheel means out of engagement with the ramp means and movement of the drawer from the closed condition.

The drawer further includes a front wall having an upper edge. The housing also includes a top wall having a top edge. The wheel means is adapted to engage the rail means when the drawer is moved to the closed condition to position the upper edge of the drawer parallel and in a predetermined spaced relationship to the front edge of the cabinet top wall.

BRIEF DESCRIPTION OF THE DRAWINGS

The invention will now be described with reference to the drawings in which.

DESCRIPTION OF THE PREFERRED EMBODIMENTS

Figure 1:
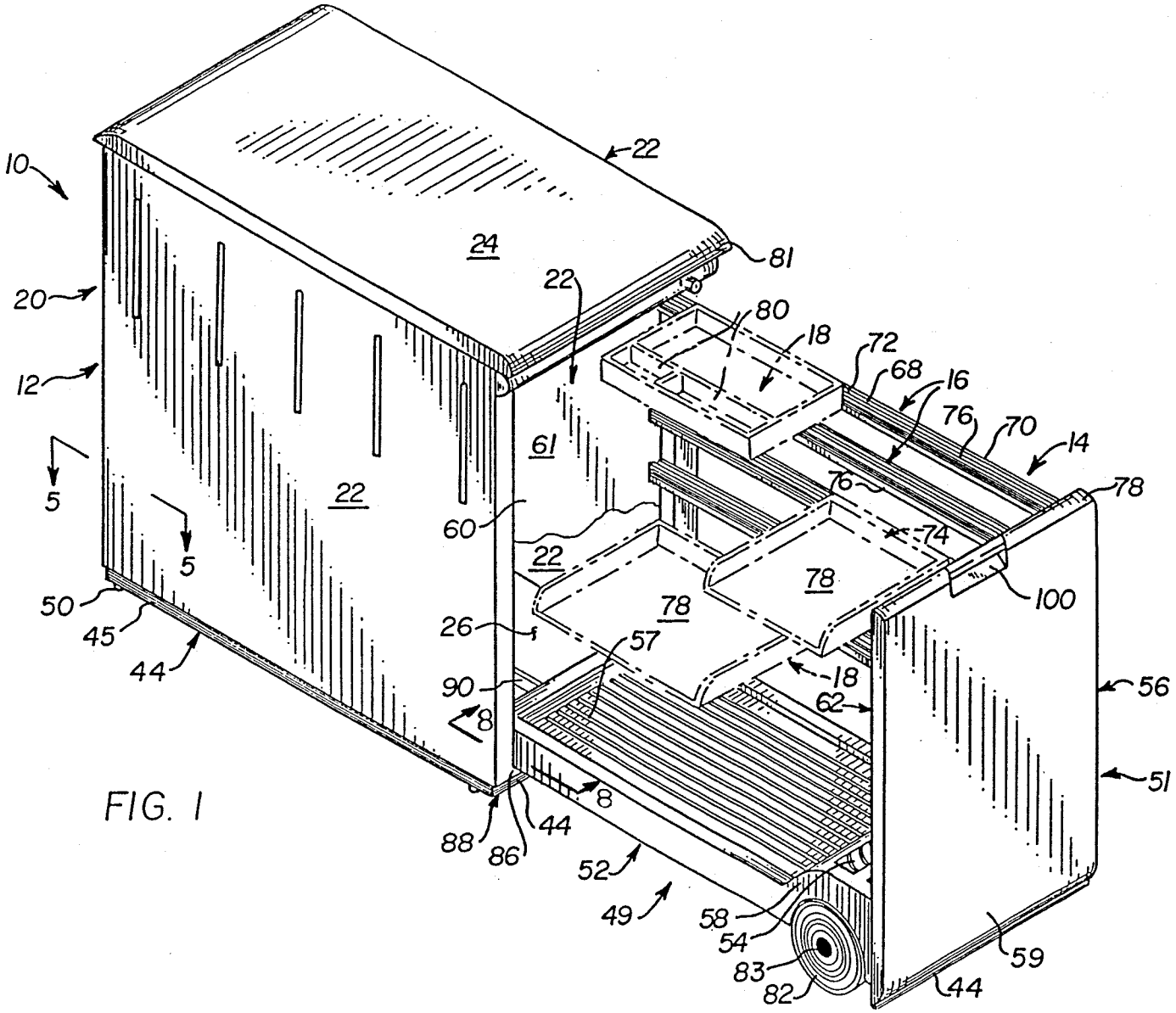
FIG. 1 is a front perspective view of a cabinet of the invention illustrating a drawer of the same in an open position and incorporating work tool support rails.

Referring now to the drawings in detail and in particular to FIG. 1, there is shown a cabinet 10 having a housing 12 and a drawer 14 slidably mounted to the housing, wherein the drawer includes a series of vertically spaced horizontal support rails 16 adapted to interchangeably support a variety of work tools 18.

The housing 12 comprises a back wall 20, a pair of sidewalls 22 and a top wall 24, the latter of which can also function as a work surface as described below. In addition, the housing 12 comprises an open front 26 and a base 28.

Figure 5:
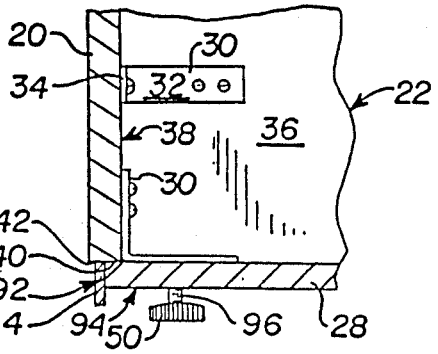
FIG. 5 is a cross-sectional view of the cabinet taken along lines 5—5 of FIG. 1.

The back and sidewalls 20, 22 can be constructed of wood or sheet metal and can be mounted together by any suitable mechanical means. Preferably, as shown in FIG. 5, the back and sidewalls 20, 22 are secured together by a glued mitered tongue and groove connection (not shown) and a plurality of L-brackets 30, with each L-bracket having a pair of first and second legs 32, 34; the first leg 32 being secured to, for example, an inside surface 36 of a sidewall 22 and the second leg 34 being secured to an inner surface 38 of the back wall 20.

The base 28 is securely mounted to the back and sidewalls 20, 22 such that upper perimetal ends 40 of the base engage the bottom axial edges 42 of the back and sidewalls 20, 22, and are positioned inwardly therefrom. L-brackets 30 are also secured to and between the base 28 and the side and back walls 20, 22 in the manner described above to securely mount the base to the back and sidewalls. In addition, although not shown in the figures, L-brackets 30 are similarly employed to securely attach the top wall 24 of the housing 12 to the back and sidewalls 20, 22.

An apron 44, preferably made of extruded plastic, is secured, for example by gluing, to rearward and side edges 92, 45 of the base 28 and side portions of a forward edge 88 of the base and extends downwardly therefrom so as to be positioned a relatively close predetermined distance above the floor.

In addition, the cabinet 10 is supported from the floor by glides 50 mounted to the base 28. The glides facilitate movement of the cabinet 10 on the floor and in the work environment when it is desired to move the cabinet within an office or between offices.

Figure 3:
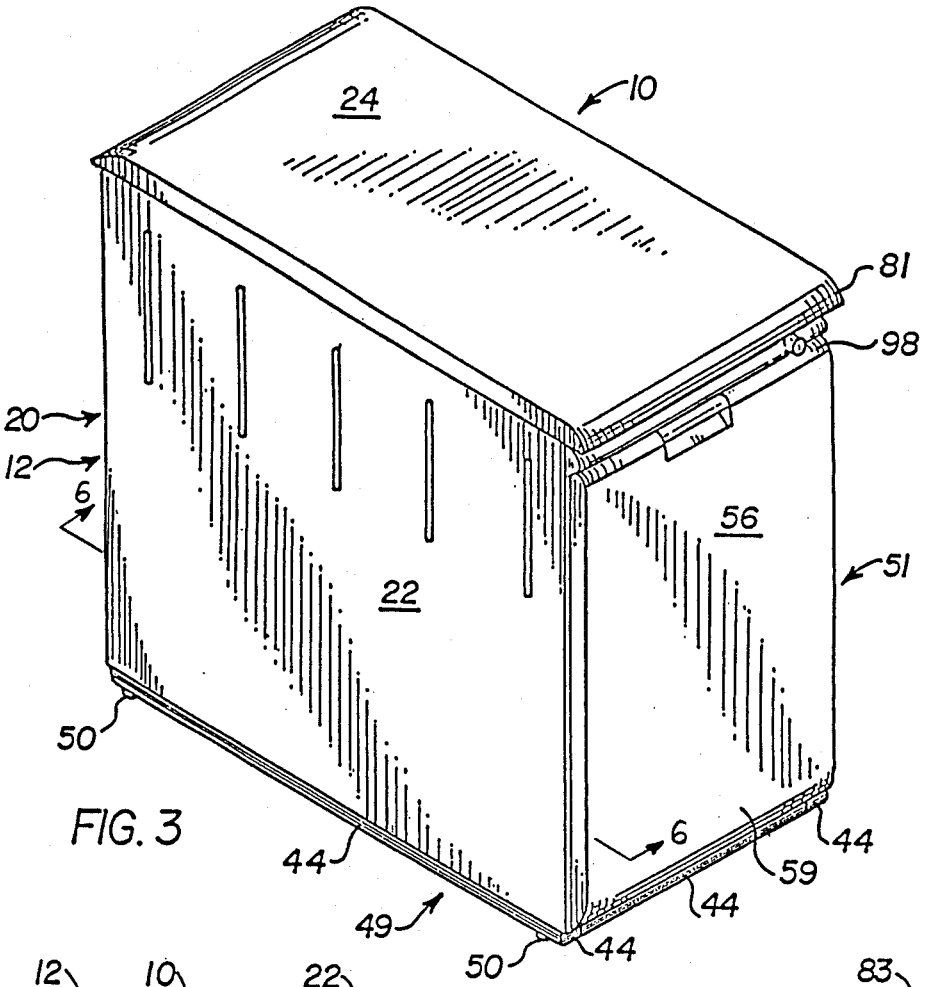
FIG. 3 is a front perspective view of the cabinet illustrating the drawer in the closed position.

In describing the drawer 14, the same will be hereinafter sometimes referred to as having a first lateral side 49 and a lateral second side 51. The drawer 14 comprises a chassis 100 over which is mounted a shroud 52 which functions as a bottom wall of the drawer. Brackets (not shown) are used to mount the shroud 52 to the chassis (not shown). The shroud is preferably made of pressure thermoformed plastic and has formed therein one or more depressions 54 which function as storage areas for work accessories, such as pencils, pens and staplers (not shown). The drawer 14 also includes a drawer front 56 which functions as a front wall of the cabinet 10. The drawer front 56 is securely mounted to the chassis (not shown) at a front portion 58 of the shroud 52 by any suitable mechanical connecting means, as by a nut and bolt connection in association with brackets (not shown). In addition, the drawer front 52 is preferably constructed out of the same materials as the side and/or top walls 22, 24 of the housing 12 to provide visual continuity between the housing and the drawer 14. The drawer front 56 has mounted to a bottom edge 49 thereof the apron 44 which is aligned with the apron 44 mounted to the forward edge 88 of the base 28 when the drawer is set in full registry with the housing as shown in FIG. 3. The drawer 14 further includes a back panel 60 securely mounted to the chassis (not shown) at a rear portion 57 of the shroud 52 and which extends upwardly therefrom a distance so as not to interfere with inward and outward movement of the drawer with respect to the housing 12. The back panel 60 is preferably mounted to the chassis (not shown) in the same manner as the drawer front 56.

Figure 2:
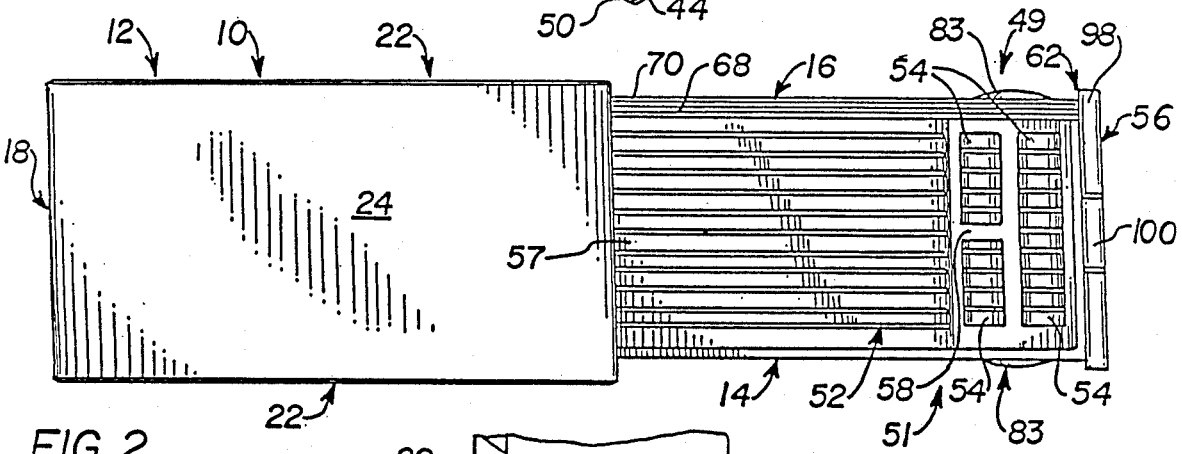
FIG. 2 is a plan view of the cabinet illustrated in FIG. 1.

The drawer 14 further includes the above-stated series of vertically spaced, horizontal, support rails 16. As shown in FIGS. 1–3, the rails 16 can be mounted to and between a rear face 62 of the drawer front 56 and a front face 61 of the back panel 60 at the first side 49 of the drawer. However, as hereinafter described in detail, the rails 16 can also be mounted to and between the back panel 60 and the drawer front 56 at the second side 51 of the drawer.

Preferably, although not illustrated in the figures, the rails 16 are mounted to and between the back panel 60 and the drawer front 56 through a pair of elongated vertically positioned mounting brackets (not shown) secured to the rear face 62 of the drawer front and the front face 61 of the back panel. Each mounting bracket (not shown) has a plurality of vertically spaced mounts (not shown), of approximately the same cross sectional configuration as the rails and extending outwardly perpendicular from the mounting bracket, and an equal number of square, in cross-section, studs extending outwardly from the mounts. The rails have square sockets (not shown) on opposite transverse ends of the rails and which receive the square studs (not shown) of the mounting brackets. When mounted to the mounting brackets (not shown), the rails 16 are substantially flush with mounts (not shown) of the same.

Each rail 16 includes an elongated channel 68 extending along substantially the full length of a top portion 70 of the rail. In addition, each rail 16 is preferably formed from a one-piece extruded member made of either aluminum or plastic.

The work tools 18 are adapted to mount to the rails 16 through downwardly-depending hooks 72 which engage the rails within the channels 68 thereof. The work tools 18 are preferably of one-piece construction and formed from molded plastic. When mounted to the rails 16, the work tools 18 are held stationary and rear walls 74 thereof are prevented from rotating out of vertical planes due to engagement of the rear walls with vertical faces 76 of the rails. The work tools 18 can include paper trays 78 and other types of trays having compartments 80 for holding work accessories such as pencils, erasers, staplers and the like (not shown).

Although the horizontal support rails 16 can be mounted to and between the drawer front 56 and the back panel 60 in any one of a variety of spaced relationships, they are preferably evenly spaced so as to span substantially the full height of the drawer 14. To this end, the mounting brackets (not shown) mounting the rails 16 to the back panel 60 and drawer front 56 span substantially the full height of the panel and drawer front. In this manner, the work tools 18 can be hung anywhere along the length of the rails 16 and at various heights in the drawer 14 to accommodate (1) varying physical characteristics of workers utilizing the cabinet 10, (2) work tools 18 of varying number and geometric size and (3) the design of a variety of organizational schemes.

Figure 4:
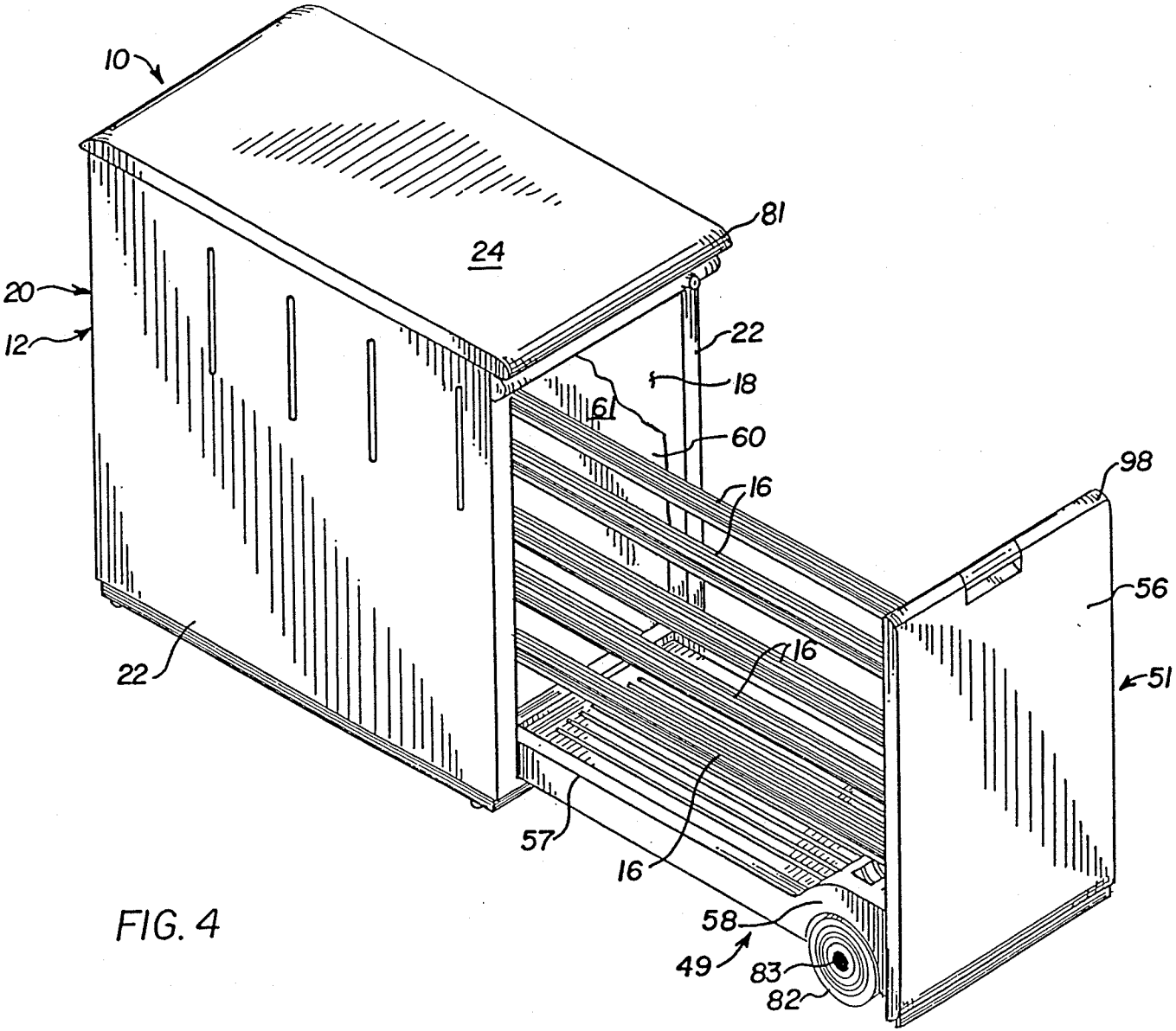
FIG. 4 is a front perspective view of the cabinet illustrating the work tool support rails on side of the drawer opposite from that shown in FIG. 1.
Figure 6:
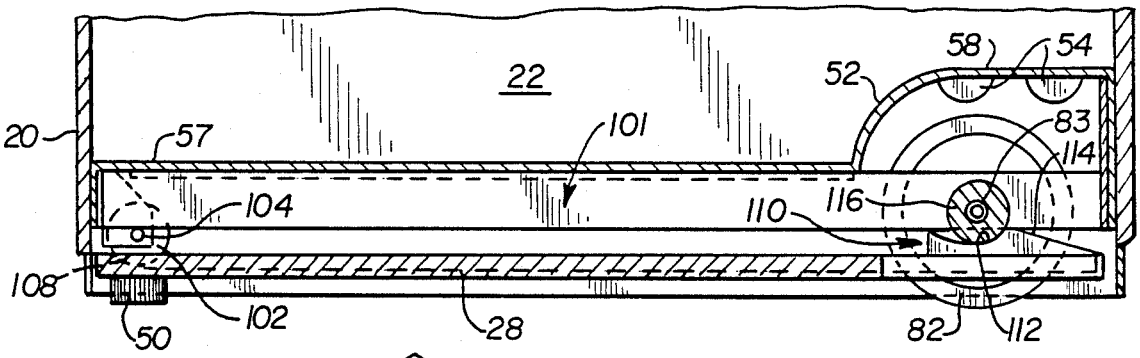
FIG. 6 is a cross-sectional view of the cabinet taken along lines 6—6 of FIG. 3.

As indicated above and as shown in the figures, the drawer 14 is slidably mounted to the housing 12 for movement in registry with the open front 26 thereof between a closed position, shown in FIG. 3, where the drawer front 56 is substantially flush with a front edge 81 of the top wall 24 of the housing, and an open position, shown in FIGS. 1, 2 and 4, where the drawer 14 is set outwardly with respect to the open front of the housing. To this end, the drawer 14 comprises a plurality of wheels mounted on axles rotatably mounted to the chassis 101. Specifically, as illustrated in FIGS. 1 and 6, the drawer 14 includes a pair of front wheels 82 mounted on a front axle 83 secured to the chassis 101 at the front portion 58 of the shroud 52. The drawer 14 also includes a rear wheel 102 rotatably mounted on a rear axle 104 secured to the chassis 101 at the rear portion 57 of the shroud 52 and centered with respect thereto.

Figure 7:
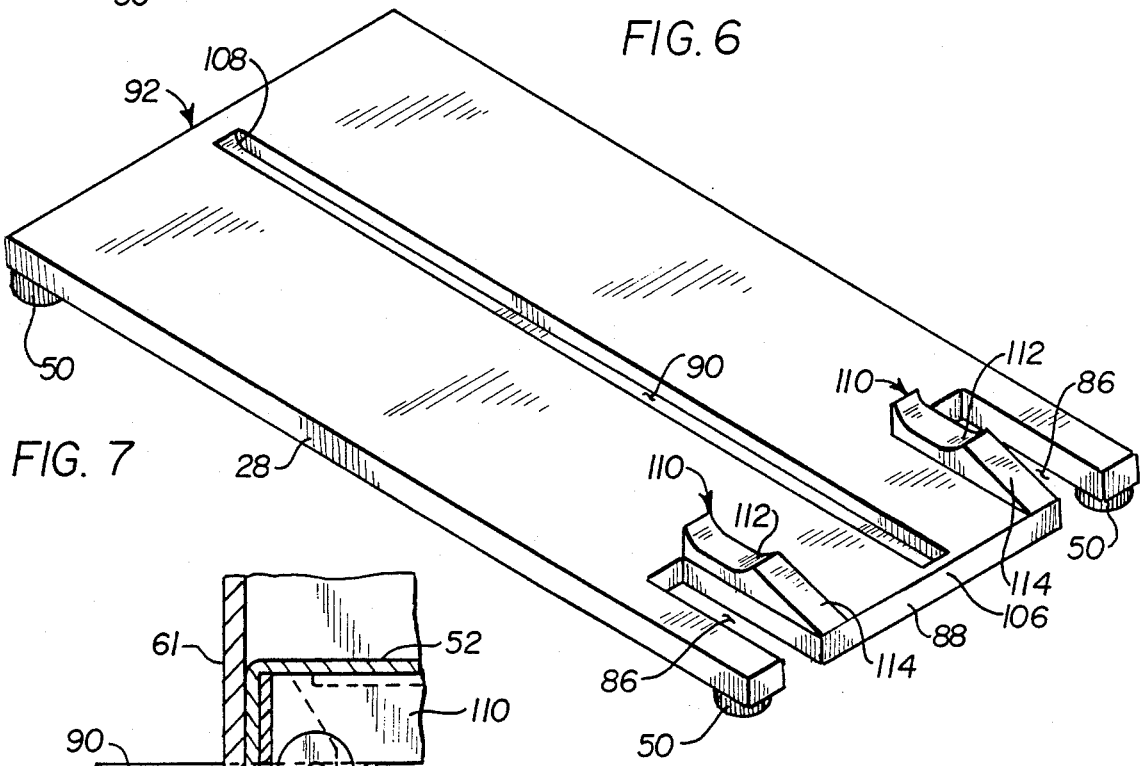
FIG. 7 is a perspective view of a base of the cabinet.
Figure 8:
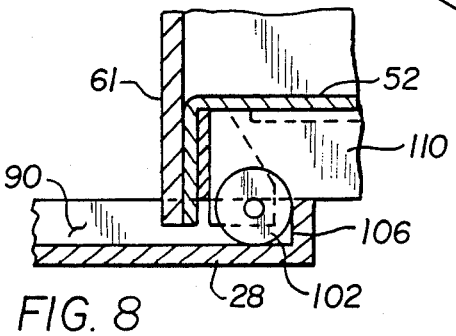
FIG. 8 is a cross-sectional view of the cabinet taken along lines 8—8 of FIG. 1.

In addition, as shown in FIGS. 1, 7 and 8, the base 24 includes a pair of relatively short side channels 86 extending inwardly a relatively short distance from a forward edge 88 of the base and aligned with the front wheels 82. The base 28 further includes a relatively long channel 90 centered with respect to the base, extending rearwardly front a point just behind the forward edge 88 of the base to a position just in front of the raarward edge 92 of the same and aligned with the rear wheel 102 of the drawer. The back panel 60 is broken away in FIG. 1 to show the channel 90. When the drawer 18 is moved between open and closed positions, the rear wheel 102 remains in registry with the long center channel 90. As shown FIG. 8, when moved from the closed position to the open position, the drawer 14 remains in registry with the housing 14 by interference of a front edge 106 of the long central channel 90 with forward movement of the rear wheel 102. As shown in FIG. 6, when the drawer 14 is moved to the closed position, the rear wheel 102 rests adjacent a rear edge 108 of the central channel 90. Because the rear wheel 102 remains in constant registry with the central channel 90 and the width of the rear wheel is substantially equal to the width of the center channel, the drawer 14 remains aligned with the open front 26 of the cabinet 10 as the drawer is moved between the open and closed positions. In addition, this dimensional relationship between the rear wheel 102 and center channel 90 is responsible for maintaining the alignment and registry of the front wheels 82 with the side channels 86 when the drawer is moved between open and closed positions.

The drawer 14 is further provided with a handle 100 for facilitating movement of the drawer between the open and closed positions.

Although the cabinet 10 can be located anywhere in the work environment, the cabinet has particularly enhanced utility when positioned adjacent a desk (not shown). Disposition of the cabinet 10 directly adjacent a transverse end (not shown) of a desk (not shown) such that the top wall 24 of the cabinet is flush with or positioned in substantially the same horizontal plane as a work surface (not shown) of the desk has numerous advantages. For example, so positioned, the cabinet top wall 24 functions as an extension of the desk work surface (not shown) along a longitudinal axis thereof. In this regard, the top wall 24 can be constructed out of the same materials and have dimensions complimentary to those of the desk work surface (not shown) so as to provide visual continuity between the cabinet 10 and the desk. In addition, when so positioned, the cabinet drawer 14 is in a convenient position for use for storage of work tools 18 utilized by a worker at the desk. The drawer 14 can be easily moved between the open and closed positions by simple arm movement of the worker and in the open position, the tools 18 can be easily rearranged on the rails to accommodate various amounts of work product which can vary from day to day.

To provide for vertical adjustment of the cabinet 10 so as to set the top wall 24 of the same in substantially the same horizontal plane as a desk work surface (not shown), the floor glides 50 are movably mounted for vertical adjustment to the base 28. For example, as shown in FIG. 5, the floor glides 50 are mounted to the base 28 through threaded sockets (not shown) rigidly secured to corners 94 of the base on first and second sides 49, 51 of the drawer, and shafts 96 are secured to the glides and threadably engage the sockets. Threading the shafts 96 to a greater or lesser extent with respect to the sockets (not shown) lowers or raises, respectively, the housing 12 and thus the cabinet top wall 24 relative to the adjacent desk work surface (not shown).

No matter at what height the housing 12 and thus the top wall 24 has been adjusted so as to position the same flush with a desk work surface (not shown), in the closed position of the drawer 14, illustrated in FIG. 3, it is aesthetically desirable to have a top edge 98 of the drawer front 56 disposed in a predetermined spaced relationship with respect to the front edge 81 of the top wall 24. Because the front wheels 82 and thus the drawer 14 can rest on the floor in the closed position, the height of the housing 12 can be varied as described above relative to the floor, and the floor can vary in elevation and contour, without means for maintaining the desired space between the top and front edges 98, 81 of the drawer front 56 and top wall 24, respectively, such spacing would vary with the vertical adjustment of the housing 12 and with varying contour of the floor.

Figure 9:
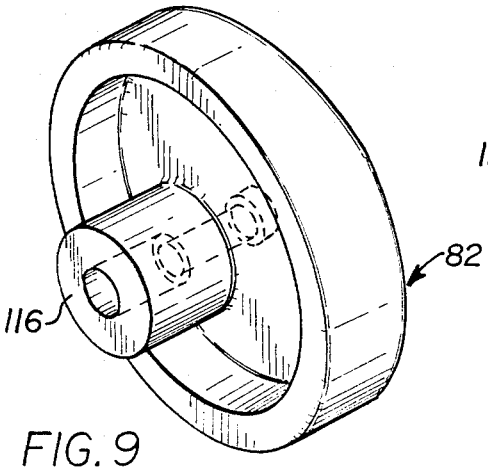
FIG. 9 is a perspective view of a floor-engaging wheel of the cabinet drawer.

To maintain the above-described desired spacing, the cabinet 10 is provided with a pair of ramps 110 securely mounted to the base 28 and positioned adjacent to and parallel with the side channels 86. As illustrated in FIGS. 6 and 7, each ramp 110 is a rectangular block-like member having a center, concave portion 112 and a sloping front portion 114. In addition, each front wheel 82 has an inner hub 116, as clearly shown in FIG. 9. The hubs 16 have a diameter less than that of the front wheels 82. Preferably, the front wheels and their inner hubs 116 are integrally formed together from single pieces plastic, such as ABS, acrylonitrile-butadiene-styrene.

In operation, when the drawer 14 is moved in the open position, the front wheels 82 are set out of registry with the side channels 86 and rotatably engage the the floor to facilitate movement of the drawer relative to the housing 12, and the hubs 116 are positioned off of the floor because of their reduced diameter. When the drawer is moved to the closed position, the front wheels 82 register with the side channels 86 and, at the same time, the hubs 116 engage the sloping front portions 114 of the ramps 110 and settle into the concave portions 112 of the ramps, the concave portions resisting movement of the hubs 116 out of engagement with the ramps and thus opening of the drawer 14. When the hubs 116 are so positioned on the ramps 110, the desired spacing between the top edge 98 and front edge 81 is maintained regardless of the height to which the housing 12 had been adjusted because the distance between the ramps on which the hubs 116 rest and the top wall 24 remains constant.

Figure 10:
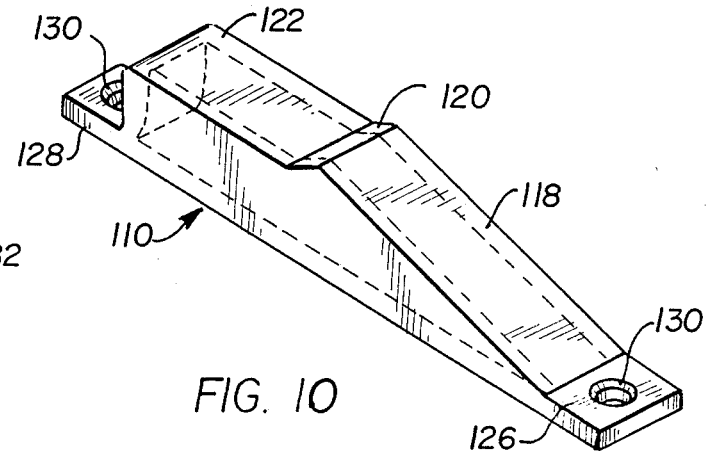
FIG. 10 is a perspective view of a ramp of the cabinet.

An alternative embodiment of the ramp 110 is illustrated in FIG. 10. In this embodiment, the ramp 110 comprises a relatively long upwardly and rearwardly sloping front part 118, a relatively short downwardly adjustment of the housing 12 and with varying contour of the floor.

To maintain the above-described desired spacing, the cabinet 10 is provided with a pair of ramps 110 securely mounted to the base 28 and positioned adjacent to and parallel with the side channels 86. As illustrated in FIGS. 6 and 7, each ramp 110 is a rectangular block-like member having a center, concave portion 112 and a sloping front portion 114. In addition, each front wheel 82 has an inner hub 116, as clearly shown in FIG. 9. The hubs 16 have a diameter less than that of the front wheels 82. Preferably, the front wheels and their inner hubs 116 are integrally formed together from single pieces plastic, such as ABS, acrylonitrile-butadiene-styrene.

In operation, when the drawer 14 is moved in the open position, the front wheels 82 are set out of registry with the side channels 86 and rotatably engage the the floor to facilitate movement of the drawer relative to the housing 12, and the hubs 116 are positioned off of the floor because of their reduced diameter. When the drawer is moved to the closed position, the front wheels 82 register with the side channels 86 and, at the same time, the hubs 116 engage the sloping front portions 114 of the ramps 110 and settle into the concave portions 112 of the ramps, the concave portions resisting movement of the hubs 116 out of engagement with the ramps and thus opening of the drawer 14. When the hubs 116 are so positioned on the ramps 110, the desired spacing between the top edge 98 and front edge 81 is maintained regardless of the height to which the housing 12 had been adjusted because the distance between the ramps on which the hubs 116 rest and the top wall 24 remains constant.

An alternative embodiment of the ramp 110 is illustrated in FIG. 10. In this embodiment, the ramp 110 comprises a relatively long upwardly and rearwardly sloping front part 118, a relatively short downwardly and rearwardly sloping center part 120 and a horizontal rear part 122. The sloping center part 120 functions like the concave portion 112 of the ramp embodiment illustrated in FIGS. 6 an 7; that is, to resist movement of a hub 116 out of engagement with the ramp. As seen in FIG. 10, the ramps can be provided with front and rear mounting flanges 126, 128. Screws (not shown) extend through holes 130 in the flanges 126, 128 and into the base 28 to mount the ramps to the base.

It should be noted that due to office layout or ambidexterity of the office worker, it may be preferable to position the cabinet 10 on one transverse side of the desk (not shown) over the other opposite transverse side of the same. Whether the cabinet 10 is positioned on one or the other transverse side of the desk, it is preferable to mount the support rails 16 to that longitudinal side of the drawer which is furthest away from the worker at the desk. When the rails 16 are mounted to the drawer 14 in this manner, the work tools 18 mounted to the rails are easily accessible by the worker. To enable the same cabinet 10 to be situated on one or the other transverse side of a desk and still have the rails positioned in the drawer in the abovedescribed desired configuration, the support rails 16 are adapted to removably mount to and between the drawer front 56 and the back panel 60 at one of the first and second sides 48, 51 of the drawer. To this end, the mounting brackets (not shown), which removably mount the rails 16 to and between the drawer front 56 and back panel 60, are removably mounted to these parts of the drawer 14 on one of the first and second sides of the same, for example, by screws (not shown) set in registry with holes (not shown) in the mounting brackets (not shown) and engaging the drawer front and back panel. Thus, if it is desired to reorganize the work area and move the cabinet from one transverse side of a desk to the other or to a different desk, the mounting brackets (not shown) and thus the rails 16 can be easily removed and remounted by a worker to either one of the first and second sides 49, 50 of the drawer 14 to obtain the above-described desired arrangement of rails in the drawer.

While the invention has been described in connection with a preferred embodiment, it will be understood that I do not intend to limit the invention to that embodiment. To the contrary, I intend to cover all alternatives, modifications and equivalents as may be included within the spirit and scope of the invention as defined by the appended claims.

I claim:

1. In a cabinet comprising a housing and a drawer, said housing including a base, said base adapted to rest on a floor, said drawer being slidably received in said housing for movement between open and closed conditions, said drawer having support means adapted to support said drawer from said floor at least in said open condition, the improvement wherein:

said drawer comprises support means having first and second support elements, said first support element being adapted to support said drawer from said floor at least in said open condition of said drawer, said second support element being connected to said first support element and extending outwardly therefrom, said second support element being spaced above said first element relative to said floor; and said housing further comprises positioning means disposed adjacent an outer edge of said base and adapted to engage said second support element when said drawer is moved to said closed condition to dispose said drawer in a predetermined position relative to said housing regardless of height of said housing relative to said floor and contour of said floor.

2. A cabinet according to claim 1, wherein said drawer further comprises an outer end;

said positioning means comprises ramp means on said base adjacent said outer edge; and said first support element comprises a floor engaging wheel at said drawer outer end for supporting said drawer from said floor at least in said open condition and for facilitating movement of said drawer between said open and closed conditions, said second support element comprising a hub on and having a reduced diameter relative to said floor engaging wheel, said hub being adapted to rotatably engage said ramp means when said drawer is moved to said closed condition to dispose said drawer in a predetermined position relative to said housing.

3. A cabinet according to claim 2, wherein said ramp means comprises means for resisting movement of said hub out of engagement with said ramp means and movement of said drawer from said closed condition.

4. A cabinet according to claim 2, wherein said drawer further comprises a front wall having an upper edge, and said housing further comprises a top wall having a front edge; and said positioning means is adapted to engage said hub when said drawer is moved to said closed condition to position said upper edge parallel and in predetermined spaced relationship to said front edge.

5. A cabinet according to claim 2, wherein said base further comprises at least one channel extending inwardly a predetermined distance from said base outer edge and aligned with said floor engaging wheel;

said ramp means comprise at least one ramp positioned adjacent said channel; and said floor engaging wheel is adapted to register with said channel, said hub being adapted to rotatably engage said ramp in said closed condition of said drawer to dispose said drawer in a predetermined position relative to said housing.

6. A cabinet according to claim 5, wherein said ramp comprises means engageable with said hub for resisting movement thereof out of engagement with said ramp and movement of said drawer from said closed condition.

7. A cabinet according to claim 2, wherein said ramp comprises an upper surface having an upwardly and rearwardly sloping front portion in a concave rear portion; and said hub is adapted to rotatably engage said sloping front and rear Concave portions when said drawer is moved to said closed condition and to rest in said concave portion in said closed condition of said drawer, said concave rear portion forming said resisting means.

8. A cabinet according to claim 2, wherein said ramp comprises an upper surface having an upwardly and rearwardly sloping front portion, a downwardly and rearwardly sloping center portion and a substantially horizontal rear portion; and said hub is adapted to rotatably engage said sloping front and center and horizontal rear portions when said drawer is moved to said closed condition and to rest on said horizontal rear portion in said closed condition of said drawer, said center sloping portion forming said resisting means.

9. A cabinet according to claim 2 wherein said base comprises first and second sides, a pair of channels at said first and second sides and extending inwardly a predetermined distance from said base outer edge;

said ramp means comprises a pair of ramps positioned adjacent said channels; and said wheel means comprises a pair of floor engaging wheels adapted to support said drawer from the floor in at least said open condition of said drawer and to register with said channels in said closed condition of said drawer, said wheels having inner hubs with reduced diameters adapted to rotatably engage said ramps when said drawer is moved to said closed condition to dispose said drawer in a predetermined position relative to said housing.

10. A cabinet according to claim 1, wherein said drawer comprises first and second lateral sides, said first lateral side being open; and said cabinet further comprises rail means mounted in said drawer and for removably supporting work tools in positions for unobstructed access thereto from said first lateral side.

11. A cabinet according to claim 10, wherein said rail means comprises a plurality of vertically spaced horizontal support rails;

whereby work tools can be supported at a plurality of horizontal and vertical positions on said support rails and in said drawer.

12. A cabinet according to claim 11, wherein said drawer further comprises a length and a height; and said rail means comprises a plurality of vertically spaced horizontal support rails spanning substantially said length and said height;

whereby work tools are adapted to be supported on said rails at a variety of vertical and horizontal positions in said drawer.

13. A cabinet according to claim 1, wherein said drawer comprises first and second lateral sides, said drawer being open at said first and second lateral sides; and said cabinet further comprises rail means removably mounted in said drawer at either one of said first and second lateral sides for removably supporting work tools for unobstructed access thereto from the other of said first and second lateral sides;

whereby said cabinet is adapted to be selectively positioned at either one of opposite sides of a workstation, with said rail means supporting work tools in said drawer for convenient access thereto from the side of the workstation at which the said cabinet has been positioned.

14. A cabinet according to claim 13, wherein said rail means comprises a plurality of vertically spaced horizontal support rails;

whereby work tools can be supported at a plurality of horizontal and vertical positions on said support rails and in said drawer.

15. A cabinet according to claim 14, wherein said support rails further comprise channels therein extending along longitudinal axes of said rails; and work tools adapted to hang on said rails comprise hook portions adapted to engage said channels to support work tools from said rails.

16. A cabinet according to claim 15, wherein said drawer further comprises a length and a height; and said support rails span substantially said length and said height;

whereby work tools are adapted to be supported on said rails at a variety of vertical and horizontal positions in said drawer.

* * * * *